US012006090B2

(12) United States Patent
Tanaka

(10) Patent No.: US 12,006,090 B2
(45) Date of Patent: Jun. 11, 2024

(54) SYNTHETIC RESIN CONTAINER

(71) Applicant: YOSHINO KOGYOSHO CO., LTD., Tokyo (JP)

(72) Inventor: Toshimasa Tanaka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 17/855,234

(22) Filed: Jun. 30, 2022

(65) Prior Publication Data

US 2023/0002102 A1 Jan. 5, 2023

(30) Foreign Application Priority Data

Jun. 30, 2021 (JP) ..... 2021-109541

(51) Int. Cl.
*B65D 1/42* (2006.01)
*B65D 1/02* (2006.01)

(52) U.S. Cl.
CPC ..... *B65D 1/42* (2013.01); *B65D 2501/0018* (2013.01)

(58) Field of Classification Search
CPC ..... B65D 1/00; B65D 1/02; B65D 1/0207; B65D 1/0223; B65D 1/023; B65D 1/0246; B65D 1/0261; B65D 1/0276; B65D 1/0284; B65D 1/0292; B65D 1/14; B65D 1/26; B65D 1/40; B65D 1/42; B65D 1/44; B65D 1/46; B65D 2205/00; B65D 23/0878; B65D 23/10; B65D 23/102; B65D 25/2885; B65D 2501/0018; B65D 2501/0027; B65D 2501/0036; B65D 2501/0081; B65D 41/00; B65D 5/2033; B65D 51/1688; B65D 79/005; B65D 79/0081; B65D 79/0084; B65D 90/36; B65D 1/165; B65D 11/24; B65D 11/26; B65D 15/18; B65D 17/02;
(Continued)

(56) References Cited

U.S. PATENT DOCUMENTS 6,527,133 B1 * 3/2003 McCollum ..... B65D 1/0223 220/660
2011/0174829 A1 * 7/2011 Yourist ..... B65D 25/32 220/660
2017/0190473 A1 * 7/2017 Garcia ..... B65D 1/0246

FOREIGN PATENT DOCUMENTS

JP 2004-149126 A 5/2004

OTHER PUBLICATIONS

Sep. 11, 2023 Office Action issued in Canadian Application No. 3,166,045.

* cited by examiner

*Primary Examiner* — Anthony D Stashick
*Assistant Examiner* — Marcos Javier Rodriguez Molina
(74) *Attorney, Agent, or Firm* — Oliff PLC

(57) ABSTRACT

A synthetic resin container has improved formability while preventing deformation of corner walls. The synthetic resin container includes a mouth that serves as a dispensing opening for contents, a body that is continuous with the mouth via a shoulder, and a bottom that closes a lower end of the body. The body includes a pair of main walls arranged so as to face each other with a gap therebetween, a pair of side walls arranged so as to face each other with a gap therebetween, and corner walls that couple respective ends in a circumferential direction of the main walls and the side walls. Each corner wall is provided with U-shaped ribs that are formed in a substantially U-shape within a surface of the
(Continued)

corner wall and that are concave toward an inner side in a thickness direction of the corner wall.

2 Claims, 3 Drawing Sheets

(58) Field of Classification Search
CPC ..... B65D 17/401; B65D 41/0442; B65D 41/0471; B65D 85/72; B65D 71/508; B65D 55/16; B65D 53/04; B65D 50/066; B65D 50/048; B65D 43/0212; B65D 41/36; B65D 41/16; B65D 41/06; B65D 41/0485; B65D 35/02; B65D 2501/24261; B65D 2501/0009; B65D 25/32; B65D 25/2897; B65D 25/2826; B65D 23/14; B65D 23/106; B65D 2251/023; B65D 2215/04; B65D 2215/02; B65D 2203/02; B65D 21/0233; B65D 21/0222; B65D 21/0215; B65D 21/0205; B65D 21/0202; B65D 19/00; B65D 17/12; B65D 17/08; B65D 1/20; B65D 1/10; B65D 1/0253
USPC ..... 215/316, 42, 384, 383, 382, 381, 379, 215/370, 256, 10, 11.1, 11.3, 11.4, 11.5, 215/11.6, 12.1, 12.2, 13.1, 2, 203, 206, 215/209, 21, 211, 213, 214, 216, 217, 215/218, 219, 220, 221, 223, 224, 225, 215/226, 227, 228, 229, 230, 232, 235, 215/237, 240, 242, 245, 246, 247, 249, 215/250, 251, 252, 253, 254, 255, 258, 215/260, 262, 270, 271, 272, 274, 276, 215/277, 279, 280, 284, 292, 295, 296, 215/304, 305, 306, 307, 308, 309, 310, 215/311, 312, 313, 317, 318, 320, 321, 215/324, 325, 326, 328, 329, 330, 332, 215/334, 336, 337, 341, 343, 344, 346, 215/347, 348, 349, 350, 351, 352, 354, 215/355, 356, 358, 364, 365, 371, 372, 215/373, 374, 375, 376, 377, 378, 380, 215/385, 386, 387, 388, 389, 391, 392, 215/393, 395, 396, 397, 398, 399, 40, 215/400, 41, 43, 44, 45, 46, 47, 48, 50, 215/53, 6, 900, 901, 902, DIG. 1, DIG. 3, 215/DIG. 6, DIG. 7, DIG. 8; 220/669, 220/645, 200, 203.01, 203.08, 203.11, 220/203.17, 212, 212.5, 223, 23.4, 23.6, 220/23.83, 23.86, 23.87, 231, 240, 253, 220/254.1, 254.2, 254.3, 254.6, 254.7, 220/254.8, 254.9, 255, 255.1, 257.2, 220/258.2, 258.3, 259.1, 259.2, 260, 265, 220/266, 268, 269, 270, 271, 276, 277, 220/278, 282, 283, 284, 288, 304, 315, 220/319, 323, 324, 359.2, 359.4, 367.1, 220/370, 373, 375, 378, 4.01, 4.07, 4.21, 220/4.27, 480, 482, 485, 495.03, 495.05, 220/495.06, 495.11, 500, 501, 502, 506, 220/509, 510, 512, 513, 515, 516, 517, 220/518, 519, 521, 523, 530, 555, 560.12, 220/567.1, 570, 571, 571.1, 575, 581, 220/588, 590, 592, 592.01, 592.02, 220/592.03, 592.09, 592.13, 592.2, 220/592.25, 592.27, 592.28, 600, 601, 220/604, 605, 606, 607, 608, 609, 611, 220/613, 614, 619, 62.11, 62.21, 62.22, 220/625, 626, 630, 633, 635, 636, 638, 220/660, 661, 666, 667, 670, 671, 672, 220/673, 674, 675, 676, 678, 681, 684, 220/693, 694, 695, 698, 700, 705, 708, 220/709, 710, 711, 714, 717, 721, 723, 220/733, 737, 738, 742, 745, 752, 784, 220/792, 8, 810, 820, 832, 833, 834, 835, 220/837, 840, 849, 89.1, 89.2, 9.2, 9.4, 220/901, 902, 903, 906, 907, 908, 909, 220/915.2, 916, 917, DIG. 11, DIG. 12, 220/DIG. 13, DIG. 14, DIG. 15, DIG. 19, 220/DIG. 2; 206/139, 144, 149, 158, 206/159, 161, 162, 164, 167, 172, 194, 206/196, 199, 201, 203, 205, 217, 218, 206/219, 220, 221, 222, 229, 232, 308.1, 206/370, 386, 427, 429, 432, 433, 438, 206/457, 459.1, 459.5, 486, 497, 499, 206/501, 503, 504, 505, 507, 508, 509, 206/510, 511, 512, 515, 518, 519, 521, 206/524.1, 532, 541, 557, 561, 563, 564, 206/565, 589, 775, 809, 821, 83.5
See application file for complete search history.

SYNTHETIC RESIN CONTAINER

CROSS-RENCE TO RELATED APPLICATION

This application claims priority to Japanese Patent Application No. 2021-109541 filed on Jun. 30, 2021, the entire contents of which are incorporated herein by reference.

TECHNICAL FIELD

The present disclosure relates to a bottle-shaped synthetic resin container including a mouth that serves as a dispensing opening for contents, a body that is continuous with the mouth via a shoulder, and a bottom that closes a lower end of the body.

BACKGROUND

Synthetic resin containers, typical examples of which include oriented polypropylene (OPP) bottles and polyethylene terephthalate (PET) bottles, are used for various applications, such as beverages, foods, or cosmetics, because they are lightweight and easy to handle, have excellent preservation stability of contents, and are low in cost.

For example, in Patent Literature 1, a square-shaped synthetic resin container is described in which vertically long recesses are provided on corner walls of the body, so as to prevent loss of rigidity of the container. By preventing deformation of the corner walls, occurrence of wrinkles on a label, such as a shrink label or a roll label, can be prevented when it is attached to the container.

CITATION LIST

Patent Literature

PTL 1: JP 2004-149126 A

SUMMARY

The present inventor has conducted earnest studies and found that it is more effective to provide annular grooves (ribs) formed in annular shapes within the surfaces of the corner walls, in order to increase rigidity of the corner walls. Generally, however, reduced pressure absorption panels are provided in such a square-shaped synthetic resin container, so as to deal with a reduced pressure that occurs when the container is cooled after it is filled with high-temperature contents. In a case in which annular grooves are provided adjacent to reduced pressure absorption panels, the width of protrusions formed in areas located between the reduced pressure absorption panels and the annular grooves narrows. As a result, during molding, resin is less likely to reach parts of a mold surface that correspond to the protrusions, thus sometimes resulting in poor formability (that causes sink marks or the like). Improvement can be made in this respect.

It would be helpful to provide a synthetic resin container with improved formability while preventing deformation of corner walls.

A synthetic resin container according to the present disclosure includes a mouth that serves as a dispensing opening for contents, a body that is continuous with the mouth via a shoulder, and a bottom that closes a lower end of the body, wherein the body includes a pair of main walls arranged so as to face each other with a gap therebetween, a pair of side walls arranged so as to face each other with a gap therebetween, and corner walls that couple respective ends in a circumferential direction of the main walls and the side walls, and each of the corner walls is provided with U-shaped ribs that are formed in a substantially U-shape within a surface of the corner wall and that are concave toward an inner side in a thickness direction of the corner wall.

In a preferred embodiment of the present synthetic resin container configured as above, each of the U-shaped ribs includes a longitudinal groove extending substantially in a vertical direction, and horizontal grooves extending substantially in a horizontal direction from both ends in the vertical direction of the longitudinal groove.

In another preferred embodiment of the present synthetic resin container configured as above, the side walls have a narrower width in the circumferential direction than the main walls, and the U-shaped ribs are formed so as to open toward the side walls.

According to the present disclosure, a synthetic resin container with improved formability can be provided while preventing deformation of corner walls.

DETAILED DESCRIPTION

Hereinafter, the present disclosure will be described in more detail by way of example with reference to the drawings.

Figure 1:
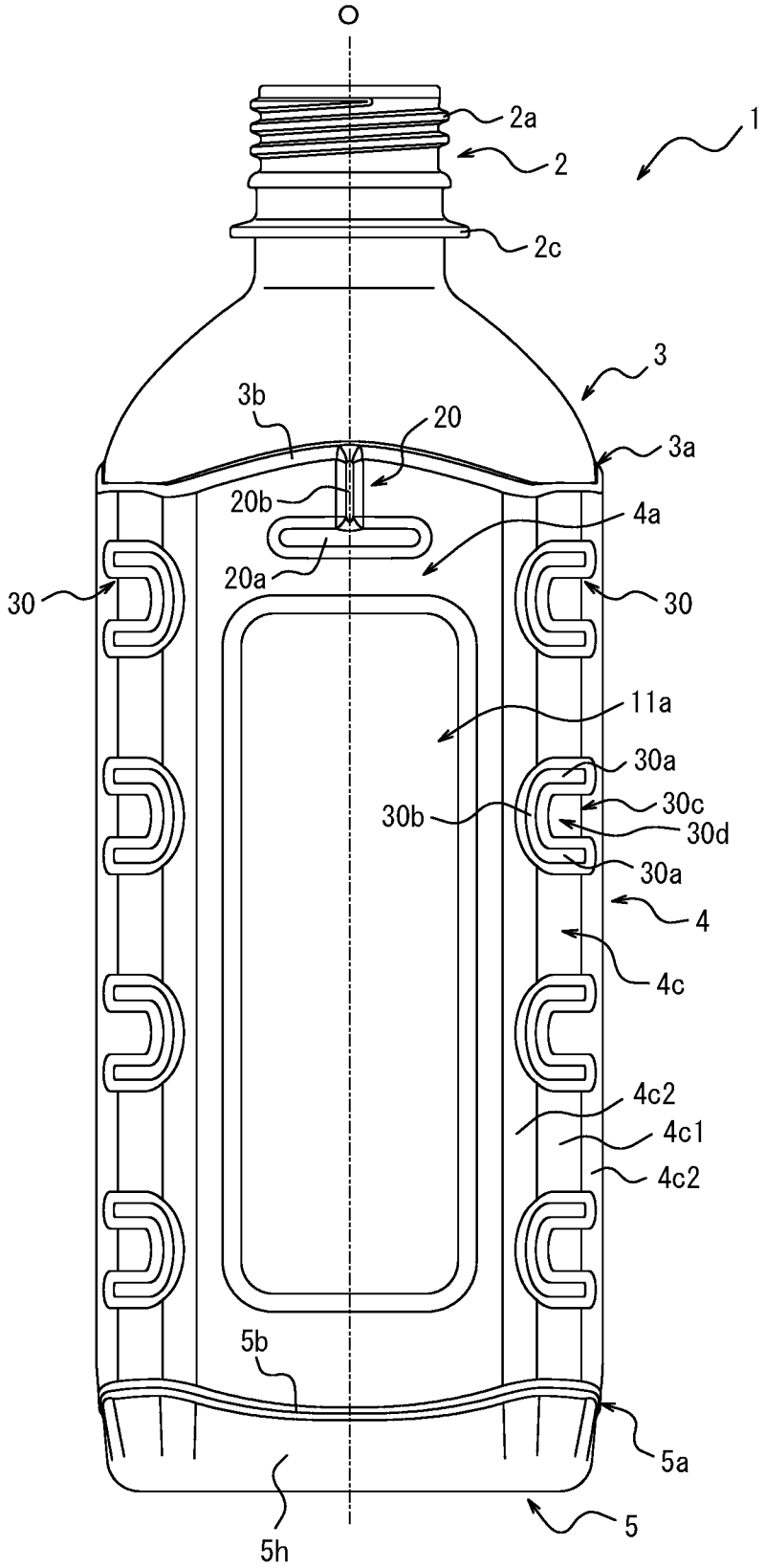
FIG. 1 is a front view of a synthetic resin container according to an embodiment of the present disclosure.

A synthetic resin container 1 of FIG. 1 according to an embodiment of the present disclosure stores, for example, beverages, such as fruit juice or tea, and seasonings, such as soy sauce, vinegar, or other sauces, as contents, and it is adapted for hot filling in which the contents are heated to a predetermined temperature before being filled into the container in a high-temperature state. In the present specification, claims, abstract, and drawings, a vertical direction is defined with reference to a state in which the synthetic resin container 1 is upright on a horizontal plane, and the term upward means upward in FIG. 1 and the term downward means downward in FIG. 1.

The synthetic resin container 1 is formed in a bottle shape including a mouth 2 that serves as a dispensing opening for contents, a shoulder 3 that is continuous with a lower end of the mouth 2 and that expands in diameter downward, a body 4 that is continuous with the mouth 2 via the shoulder 3 and that has a rectangular shape in the plan view (refer to FIG. 3), and a bottom 5 that closes a lower end of the body 4. An area below a stepped portion 5*a* located below the body 4 is referred to as a heel portion 5*h*. Reference sign O in FIG. 1 represents a central axis common to the mouth 2, the shoulder 3, the body 4, and the bottom 5. In the present specification and claims, a radial direction is a direction that passes the central axis O and that is also perpendicular to the central axis O. A direction toward an inner side in the radial direction is a direction toward the central axis O along the radial direction, and a direction toward an outer side in the radial direction is a direction away from the central axis O along the radial direction.

The synthetic resin container 1 can be configured as a so-called PET bottle, by biaxially stretch blow molding a preform made of polyethylene terephthalate (PET), for example. The synthetic resin container 1 is not limited to polyethylene terephthalate, and it can also be formed by biaxially stretch blow molding a preform made of other thermoplastic resins, such as oriented polypropylene (OPP). In addition to biaxial stretch blow molding of a preform, various manufacturing methods can be adopted to manufacture the synthetic resin container 1, such as extrusion blow molding of a resin material.

As illustrated in FIG. 1, a male thread 2*a* is formed on an outer peripheral surface of the mouth 2. After the contents are hot-filled, a cap that is not illustrated can be screw-engaged with the mouth 2 so as to close the mouth 2. Instead of the male thread 2*a* provided on the outer peripheral surface of the mouth 2, a projection may be provided, and a cap as a plug may be engaged with the projection, so as to close the mouth 2. A neck ring 2*c* may be provided below the male thread 2*a* of the mouth 2, so as to support the synthetic resin container 1 when the contents are filled into the synthetic resin container 1, for example. The neck ring 2*c* projects in an annular shape toward the outer side in the radial direction from the outer peripheral surface of the mouth 2.

Figure 3:
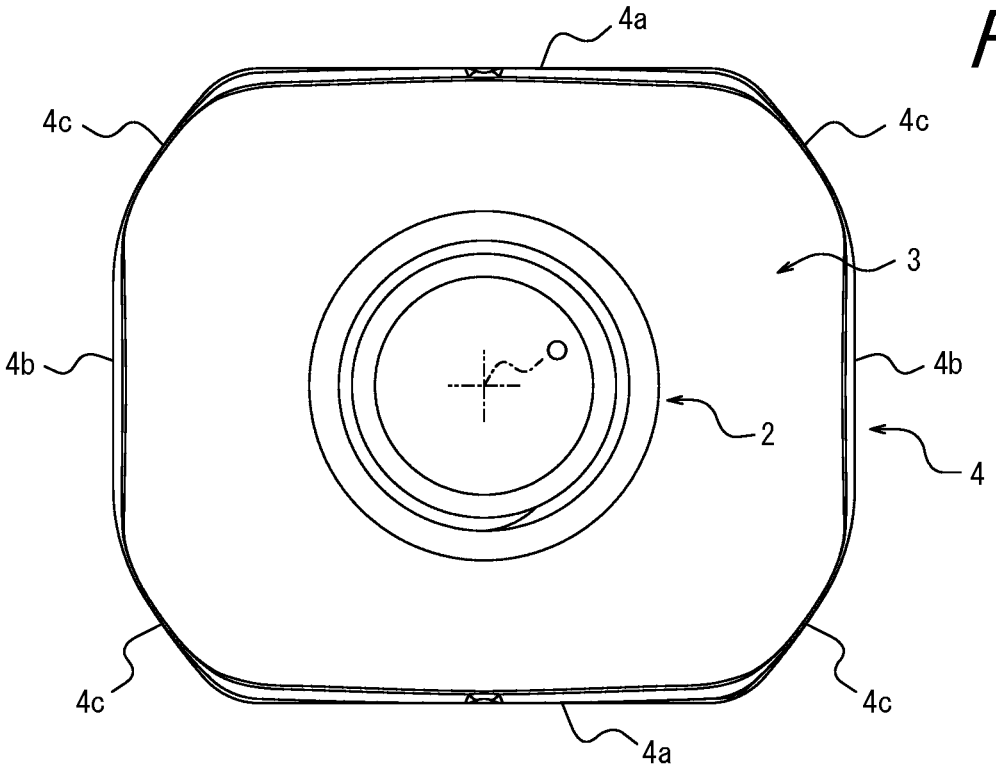
FIG. 3 is a plan view of the synthetic resin container according to the embodiment of the present disclosure.

As illustrated in FIG. 3 or the like, the body 4 has a rectangular tube structure having a chamfered rectangular shape in the plan view. The body 4 includes a pair of main walls 4*a* and a pair of side walls 4*b*. The pair of main walls 4*a* are arranged so as to face each other with a gap therebetween. The pair of side walls 4*b* are substantially orthogonal to the main walls 4*a*, arranged so as to face each other with a gap therebetween, and coupled to respective ends in the circumferential direction of the main walls 4*a* via corner walls 4*c*.

Figure 2:
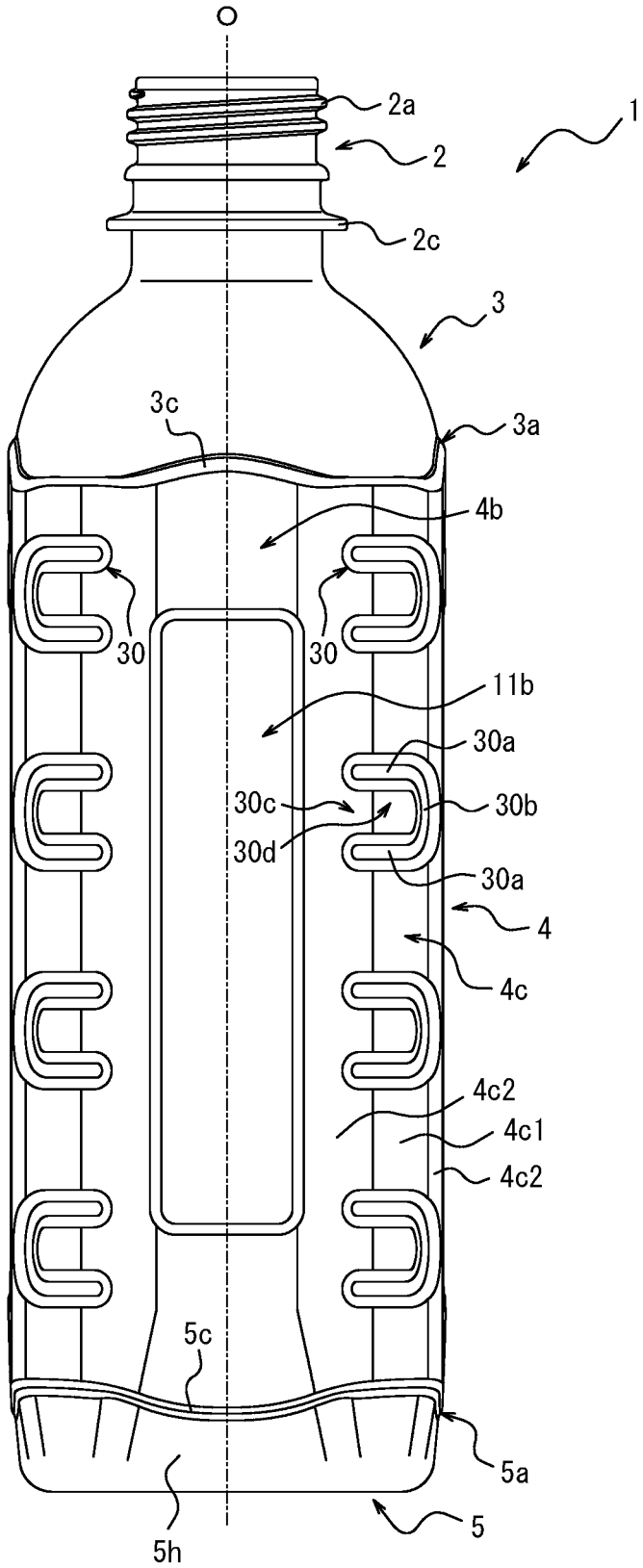
FIG. 2 is a side view of the synthetic resin container according to the embodiment of the present disclosure.

The main walls 4*a* and the side walls 4*b* are formed substantially in flat plate shapes, and both have vertically long shapes, as illustrated in FIG. 1 and FIG. 2. The main walls 4*a* each include a reduced pressure absorption panel 11*a* located at a substantially central position within the surface, and the side walls 4*b* each include a reduced pressure absorption panel 11*b* located at a substantially central position within the surface. The reduced pressure absorption panels 11*a*, 11*b* have vertically long shapes similarly with the main walls 4*a* and the side walls 4*b*. In the present embodiment, the pair of main walls 4*a* facing each other have the same shape as each other, and the pair of side walls 4*b* facing each other also have the same shape as each other. Similarly, the pair of reduced pressure absorption panels 11*a* facing each other have the same shape as each other, and the pair of reduced pressure absorption panels 11*b* facing each other also have the same shape as each other.

The reduced pressure absorption panels 11*a*, 11*b* are arranged on the main walls 4*a* and the side walls 4*b* at substantially central positions in the horizontal and vertical directions, as illustrated in FIG. 1 and FIG. 2. The reduced pressure absorption panels 11*a*, 11*b* are formed so as to cave in toward the inner side in the radial direction from the main walls 4*a* and the side walls 4*b*. This configuration of the reduced pressure absorption panels 11*a*, 11*b* that is three-dimensional in the radial direction can prevent unfavorable deformation that occurs in unexpected parts of the body 4 after the contents being hot-filled into the synthetic resin container 1. That is, in a case in which the contents are hot-filled into the synthetic resin container 1 and the mouth 2 is subsequently closed with a cap, the contents cool, and accordingly, a reduced pressure is created inside the container. In response to the reduced pressure inside the container, the reduced pressure absorption panels 11*a*, 11*b* with the three-dimensional shape in the radial direction can easily undergo elastic deformation toward the inner side of the container and absorb the reduced pressure, thereby preventing unfavorable deformation that occurs in unexpected parts of the body 4.

Although in the present embodiment the reduced pressure absorption panels 11*a*, 11*b* have a relatively simple configuration by which they are depressed toward the inner side in the radial direction at the outer edges, the present disclosure is not limited to this. For example, recesses and protrusions may be alternately arranged adjacent to each other so that the reduced pressure absorption panels 11*a*, 11*b* can be even more easily deformed toward the inner side in the radial direction, whereby the reduced pressure absorption effect can be enhanced. Additionally, the reduced pressure absorption panels 11*a*, 11*b* may be provided on only either the main walls 4*a* or the side walls 4*b*, and the reduced pressure absorption panels 11*a*, 11*b* may also be omitted.

A stepped portion 3*a* is formed in boundary areas of the main walls 4*a* and the side walls 4*b* with respect to the shoulder 3, as illustrated in FIG. 1 and FIG. 2. The stepped portion 3*a* is slightly reduced in diameter toward the inner side in the radial direction from the main walls 4*a* and the side walls 4*b* to the shoulder 3. As illustrated in FIG. 1, the stepped portion 3*a* includes a substantially arc-shaped protrusion 3*b* that bulges (to be convex) toward the outer side (upward in the step portion 3*a* of FIG. 1) in the vertical direction at the substantially central position in the circumferential direction of each main wall 4*a*. As illustrated in FIG. 2, the stepped portion 3*a* also includes a substantially arc-shaped protrusion 3*c* that is convex upward at the substantially central position in the circumferential direction of each side wall 4*b*. By thus providing the stepped portion 3*a* at a lower end of the shoulder 3, the container can be prevented from undergoing plastic deformation (distortion and deformation) in a direction that causes creases to form in the vertical direction at this area. In particular, providing the stepped portion 3*a* with the protrusions 3*b*, 3*c* exerts a preventive effect against not only distortion in the direction that causes creases to form in the vertical direction but also distortion in a direction that causes creases to form in the horizontal direction. Additionally, the protrusions 3*b*, 3*c* of the stepped portion 3*a* do not necessarily need to be formed in substantially arc shapes, and they may have other shapes, such as triangular or trapezoidal shapes. Further, the stepped portion 3*a* may include only the protrusions 3*b* on the main walls 4*a* or the protrusions 3*c* on the side walls 4*b*. The protrusions 3*b*, 3*c* may also be omitted, and the stepped portion 3*a* may extend linearly in the circumferential direction.

A stepped portion 5*a* is formed in boundary areas of the main walls 4*a* and the side walls 4*b* with respect to the heel portion 5*h*, as illustrated in FIG. 1 and FIG. 2. The stepped portion 5*a* is slightly reduced in diameter toward the inner side in the radial direction from the main walls 4*a* and the side walls 4*b* to the heel portion 5*h*. As illustrated in FIG. 1, the stepped portion 5*a* includes a substantially arc-shaped protrusion 5*b* that bulges (to be convex) toward the outer side (downward in the stepped portion 5*a* of FIG. 1) in the vertical direction at the substantially central position in the circumferential direction of each main wall 4*a*. As illustrated in FIG. 2, the stepped portion 5*a* also includes a substantially arc-shaped protrusion 5*c* that is convex downward at the substantially central position in the circumferential direction of each side wall 4*b*. By thus providing the stepped portion 5*a* at lower portions of the main walls 4*a* and the side walls 4*b*, the container can be prevented from undergoing plastic deformation (distortion and deformation) in a direction that causes creases to form in the vertical direction at these areas. In particular, providing the stepped portion 5*a* with the protrusions 5*b*, 5*c* exerts a preventive effect against not only distortion in the direction that causes creases to form in the vertical direction but also distortion in a direction that causes creases to form in the horizontal direction. Additionally, the protrusions 5*b*, 5*c* of the stepped portion 5*a* do not necessarily need to be formed in substantially arc shapes, and they may have other shapes, such as triangular or trapezoidal shapes. Further, the stepped portion 5*a* may include only the protrusions 5*b* on the main walls 4*a* or the protrusions 5*c* on the side walls 4*b*. The protrusions 5*b*, 5*c* may also be omitted, and the stepped portion 5*a* may extend linearly in the circumferential direction.

A T-shaped rib 20 is provided in an area located at the central position in the circumferential direction of an upper end of each main wall 4*a* between the reduced pressure absorption panel 11*a* and the stepped portion 3*a*, as illustrated in FIG. 1. The T-shaped rib 20 includes a transverse groove 20*a* and a longitudinal groove 20*b*. The transverse groove 20*a* extends substantially in the horizontal direction and is concave toward an inner side in a thickness direction of the body 4. The longitudinal groove 20*b* is continuous with the transverse groove 20*a*, extends in an upward direction substantially orthogonal to the transverse groove 20*a*, and is concave toward the inner side in the thickness direction of the body 4. In the present embodiment, the longitudinal groove 20*b* is configured so that its upper end overlaps the stepped portion 3*a*. This configuration can enhance both the rigidity in a direction concerning formation of creases in the vertical direction and the rigidity in a direction concerning formation of creases in the horizontal direction within the main wall 4*a*, thereby improving restoring force. Distortion and deformation within the main wall 4*a* can therefore be more effectively prevented.

Although the upper end (tip) of the longitudinal groove 20*b* extends to the stepped portion 3*a*, the present disclosure is not limited to this. The longitudinal groove 20*b* may extend beyond the stepped portion 3*a* to the shoulder 3. By the longitudinal groove 20*b* extending to the stepped portion 3*a*, rigidity can be enhanced within and across an area surrounded by ridges that define the main wall 4*a*, and distortion and deformation of the main wall 4*a* can therefore be more effectively prevented. The longitudinal groove 20*b* may also extend in the vicinity of the stepped portion 3*a*, while terminating before reaching the stepped portion 3*a*.

In the present embodiment, the transverse groove 20*a* is formed deeper toward the inner side in the thickness direction of the body 4 than the longitudinal groove 20*b*. This configuration further enhances rigidity against distortion in a direction that causes creases to form in the vertical direction, thereby more effectively preventing distortion and deformation.

Although in the present embodiment the T-shaped rib 20 is arranged at the upper end of the main wall 4*a*, the present disclosure is not limited to this. For example, a T-shaped rib 20 may be provided in an area located at the central position in the circumferential direction of a lower end of the main wall 4*a* between the reduced pressure absorption panel 11*a* and the stepped portion 5*a*. In this case, the T-shaped rib 20 includes a transverse groove 20*a* that extends substantially in the horizontal direction, and a longitudinal groove 20*b* that is continuous with the transverse groove 20*a* and that extends in a downward direction substantially orthogonal to the transverse groove 20*a*. In this case also, a lower end of the longitudinal groove 20*b* may extend to the stepped portion 5*a*, or the longitudinal groove 20*b* may extend beyond the stepped portion 5*a* to the heel portion 5*h*. The longitudinal groove 20*b* may also extend in the vicinity of the stepped portion 5*a*, while terminating before reaching the stepped portion 5*a*.

Further, the body 4 may be divided in the vertical direction into an upper body and a lower body by a peripheral groove that is not illustrated, and a longitudinal groove 20*b* of a T-shaped rib 20 provided at a lower end of the upper body may extend to the peripheral groove or extend beyond the peripheral groove to the lower body. In this case also, the longitudinal groove 20*b* may extend in the vicinity of the peripheral groove, while terminating before reaching peripheral groove.

Moreover, the body 4 may be divided in the vertical direction into an upper body and a lower body by a peripheral groove that is not illustrated, and a longitudinal groove 20*b* of a T-shaped rib 20 provided at an upper end of the lower body may extend to the peripheral groove or extend beyond the peripheral groove to the upper body. In this case also, the longitudinal groove 20*b* may extend in the vicinity of the peripheral groove, while terminating before reaching the peripheral groove.

Although in the present embodiment the T-shaped ribs 20 are provided only on the main walls 4*a*, the present disclosure is not limited to this. T-shaped ribs 20 may be provided on the side walls 4*b*, in addition to the main walls 4*a*, or only on the side walls 4*b*.

Figure 4:
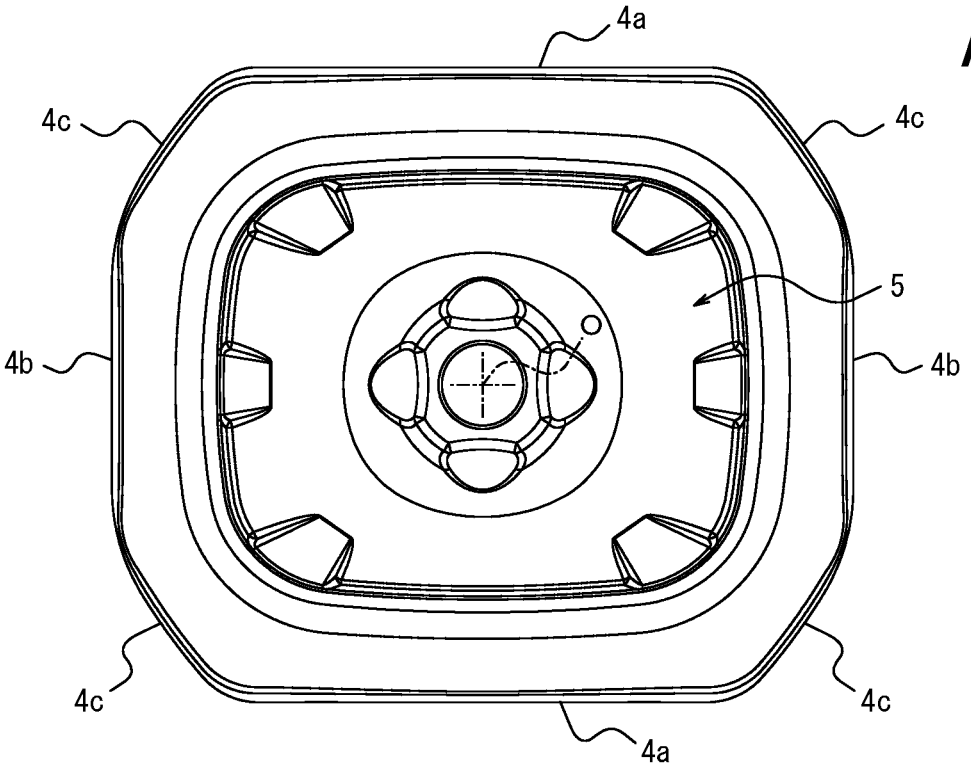
FIG. 4 is a bottom view of the synthetic resin container according to the embodiment of the present disclosure.

As illustrated in FIG. 3 and FIG. 4, the corner walls 4*c* are provided at four locations along the circumferential direction of the body 4. The corner walls 4*c* couple respective ends in the circumferential direction of the main walls 4*a* and the side walls 4*b*. Each corner wall 4*c* is formed as a chamfered edge of the body 4 with a substantially rectangular shape in the plan view. In the present embodiment, the corner wall 4*c* includes a central corner wall 4*c*1 and side corner walls 4*c*2, as illustrated in FIG. 1 and FIG. 2. The central corner wall 4*c*1 is provided in the middle in the circumferential direction and made of a curved surface. The side corner walls 4*c*2 are made of curved surfaces adjacent to, and located on either side in the circumferential direction of, the central corner wall 4*c*1. The corner walls 4*c* may be made of only one or more flat surfaces, or they may be made of one curved surface or a combination of curved and flat surfaces.

In order to increase rigidity of each corner wall 4*c*, U-shaped ribs 30 are provided on the corner wall 4*c*, as illustrated in FIG. 1 and FIG. 2. Each U-shaped rib 30 is formed in a substantially U-shape within a surface of the corner wall 4*c* and is recessed toward the inner side in the thickness direction of the corner wall 4*c*. In the present embodiment, the U-shaped rib 30 includes a longitudinal groove 30*b* and a transverse groove 30*a*. The longitudinal groove 30*b* extends in the vertical direction while drawing substantially an arc that is convex toward an adjacent main wall 4*a*, and the transverse groove 30*a* extends substantially in the horizontal direction from both ends in the vertical direction of the longitudinal groove 30*b*. As illustrated in FIG. 2, the U-shaped rib 30 is formed so that its opening 30*c* is open toward an adjacent side wall 4*b*, and the periphery of the U-shaped rib 30 and a central protrusion 30*d* surrounded by the U-shaped rib 30 are coupled via the opening 30*c*. In the present embodiment, four U-shaped ribs 30 are arranged with a substantially regular gap in the vertical direction on each corner wall 4*c*. Both ends in the circumferential direction of the U-shaped ribs 30 may extend to the adjacent main wall 4*a* and/or the adjacent side wall 4*b*.

In order to increase rigidity of the corner walls 4*c*, it is effective to provide annular ribs obtained by closing the openings 30*c* of the U-shaped ribs 30 of FIG. 2. However, in a case in which annular ribs are provided on the corner walls 4*c*, longitudinal grooves are also formed at the positions of the openings 30*c* of FIG. 2. As a result, during molding, resin is less likely to reach protrusions located between the longitudinal grooves (recesses) and the reduced pressure absorption panels 11*b* (concave part) of the side walls 4*b* that have a narrow width in the circumferential direction, thus resulting in poor formability and causing sink marks. In the present embodiment, as illustrated in FIG. 2, the U-shaped ribs 30 include the openings 30*c* provided near the side walls 4*b* with a narrow width. Accordingly, there is no protruding portion with a narrow width, and the peripheries of the U-shaped ribs 30 and the central protrusions 30*d* surrounded by the U-shaped ribs 30 are coupled via the openings 30*c*. Poor formability is therefore prevented.

Although in the present embodiment the U-shaped ribs 30 each have an ideal U-shape as illustrated in FIG. 2, the present disclosure is not limited to this. Each longitudinal grooves 30*b* may linearly extend in the vertical direction or may have an R-shape with an even smaller radius of curvature. Further, by bringing parts of each transverse groove 30*a* that are located near the opening 30*c* closer to each other in the vertical direction, the U-shaped rib 30 may have a substantially C-shape. Moreover, the openings 30*c* do not necessarily need to be provided to be oriented toward the side walls 4*b*, and they may be provided to be oriented toward the main walls 4*a* or in the vertical direction.

Additionally, in the present embodiment, the body 4 has a chamfered rectangular shape in the plan view, and it includes two main walls 4*a* and two side walls 4*b* that constitute the rectangular portion, and four corner walls 4*c* that constitute the chamfered portion. The present disclosure is, however, not limited to this. For example, the body 4 may be configured so that the main walls 4*a* and the side walls 4*b* have substantially the same width in the circumferential direction, or the body 4 may have substantially an octagonal shape in the plan view, wherein four main walls 4*a* and four side walls 4*b* are alternately arranged via corner walls 4*c*. Other configurations may also be adopted.

As described above, the synthetic resin container 1 according to the present embodiment is a synthetic resin container 1 including a mouth 2 that serves as a dispensing opening for contents, a body 4 that is continuous with the mouth 2 via a shoulder 3, and a bottom 5 that closes a lower end of the body 4, wherein the body 4 includes a pair of main walls 4*a* arranged so as to face each other with a gap therebetween, a pair of side walls 4*b* arranged so as to face each other with a gap therebetween, and corner walls 4*c* that couple respective ends in a circumferential direction of the main walls 4*a* and the side walls 4*b*, and each of the corner walls 4*c* is provided with U-shaped ribs 30 that are formed in a substantially U-shape within a surface of the corner wall 4*c* and that are concave toward an inner side in a thickness direction of the corner wall 4*c*. By adopting such a configuration, rigidity is increased in the corner walls 4*c*. Besides, by providing the openings 30*c* to be oriented toward where protrusions with a narrow width are formed, filling of resin to the protrusions can be facilitated. Thus, the synthetic resin container 1 with improved formability can be provided while preventing deformation of the corner walls 4*c*.

Further, in the present embodiment, each U-shaped rib 30 is configured to include a longitudinal groove 30*b* that extends substantially in the vertical direction, and a transverse groove 30*a* that extends substantially in the horizontal direction from both ends in the vertical direction of the longitudinal groove 30*b*. By adopting such a configuration, rigidity of the corner walls 4*c* against pressing force in the radial direction can be enhanced by the transverse grooves 30*a*, and rigidity of the corner walls 4*c* against pressing force in the vertical direction can be increased by the longitudinal grooves 30*b*. Thus, the synthetic resin container 1 with improved formability can be provided while more effectively preventing deformation of the corner walls 4*c*.

Moreover, in the present embodiment, the side walls 4*b* have a narrower width in the circumferential direction than the main walls 4*a*, and the U-shaped ribs 30 are configured to open toward the side walls 4*b*. By adopting such a configuration, since the openings 30*c* of the U-shaped ribs 30 are provided near the side walls 4*b* with a narrow width in the circumferential direction, there is no protruding portion with a narrow width between the reduced pressure absorption panels 11*b* and the U-shaped ribs 30, and the peripheries of the U-shaped ribs 30 and the central protrusions 30*d* surrounded by the U-shaped ribs 30 are coupled via the openings 30*c*. Poor formability and occurrence of sink marks can therefore be more effectively prevented.

While the present disclosure has been described based on the drawings and examples, it is to be noted that various changes and modifications may be implemented by those skilled in the art based on the present disclosure. Accordingly, such changes and modifications are included within the scope of the present disclosure. For example, functions or the like included in each component can be rearranged without logical inconsistency, and a plurality of components can be combined together or divided. These are to be understood as included in the scope of the present disclosure.

For example, the pair of main walls 4*a* do not need to have the same shape as each other, and the pair of side walls 4*b* do not need to have the same shape as each other. The main walls 4*a* may have different shapes from each other, and the side walls 4*b* may have different shapes from each other. Further, the shapes of the reduced pressure absorption panels 11*a*, 11*b* are not limited to the above embodiment, and various configurations can be adopted. Each of the reduced pressure absorption panels 11*a*, 11*b* may have a different shape from each other.

Further, the number of reduced pressure absorption panels 11*a*, 11*b*, T-shaped ribs 20, and U-shaped ribs 30 are not limited to the above embodiment. For example, two or more reduced pressure absorption panels 11*a* may be provided on one main wall 4*a*, or reduced pressure absorption panels 11*a* may be provided only on some of main walls 4*a*. Two or more T-shaped ribs 20 may be provided on one main wall 4*a*. Any number of U-shaped ribs 30 may be provided on one corner wall 4*c*.

Moreover, although in the present embodiment the side walls 4*b* have a narrower width in the circumferential direction than the main walls 4*a*, and the U-shaped ribs 30 are configured to open toward the side walls 4*b*, the present disclosure is not limited to this. In a case in which protrusions with a narrow width are formed between the U-shaped ribs 30 and recessed portions other than the reduced pressure absorption panels 11*a*, 11*b*, the openings 30*c* may be provided to be oriented toward the protrusions.

The contents to be filled into the synthetic resin container 1 are not limited to beverages, such as fruit juice or tea, and seasonings, such as soy sauce, vinegar, or other sauces, and they may also include other foods and cosmetics.

The invention claimed is:

1. A synthetic resin container comprising a mouth that serves as a dispensing opening for contents, a body that is continuous with the mouth via a shoulder, and a bottom that closes a lower end of the body, wherein the body includes a pair of main walls arranged so as to face each other with a gap therebetween, a pair of side walls arranged so as to face each other with a gap therebetween, and corner walls that couple respective ends of the main walls that extend along a central axis of the synthetic resin container to respective ends of the side walls that extend along the central axis of the synthetic resin container, and all of the corner walls are provided with U-shaped ribs that are formed in a substantially U-shape, that are formed only within a surface of the corner wall, and that are concave toward an inner side in a thickness direction of the corner wall, wherein each of the U shaped ribs includes a longitudinal groove extending substantially in a vertical direction, horizontal grooves extending substantially in a horizontal direction from both ends of the longitudinal groove in the vertical direction, an opening at an end opposite from the longitudinal groove between the horizontal grooves, and a central protrusion surrounded by the longitudinal groove and the horizontal grooves, and the central protrusion is at least partially present between:

(i) the horizontal grooves in the vertical direction and (ii) the longitudinal groove and the opening in the horizontal direction.

2. The synthetic resin container according to claim 1, wherein the side walls have a narrower width in a direction transverse to the central axis of the synthetic resin container than a width of the main walls in another direction transverse to the central axis of the synthetic resin container, and the U-shaped ribs are formed so as to open toward the side walls.

* * * * *